US005800677A

United States Patent [19]

Kato

[11] Patent Number: 5,800,677

[45] Date of Patent: Sep. 1, 1998

[54] METHOD FOR PREVENTING PITCH TROUBLE

[75] Inventor: Yasuo Kato, Ashiya, Japan

[73] Assignee: Nissin Kagaku Kenkyusho Co., Ltd., Japan

[21] Appl. No.: 737,747

[22] PCT Filed: Mar. 28, 1996

[86] PCT No.: PCT/JP96/00874

§ 371 Date: Mar. 24, 1997

§ 102(e) Date: Mar. 24, 1997

[87] PCT Pub. No.: WO96/30585

PCT Pub. Date: Oct. 3, 1996

[30] Foreign Application Priority Data

Mar. 30, 1995 [JP] Japan ..... 7-073524

[51] Int. Cl.[6] ..... D21C 9/08

[52] U.S. Cl. ..... 162/199; 162/179; 162/158; 162/DIG. 4

[58] Field of Search ..... 162/199, 179, 162/158, DIG. 4; 106/635, 254, 419; 252/389.52, 400.52, 75; 510/353

[56] References Cited

U.S. PATENT DOCUMENTS

| | | | |
|---|---|---|---|
| 2,133,694 | 10/1938 | Greider | 162/179 |
| 2,563,856 | 8/1951 | McGinn | 162/179 |
| 2,563,857 | 8/1951 | McGinn | 162/179 |
| 2,715,614 | 8/1955 | Snook | 162/179 |
| 2,767,089 | 10/1956 | Renfrew | 162/179 |
| 2,944,931 | 7/1960 | Yang | 162/179 |
| 3,920,807 | 11/1975 | Curry et al. | 424/46 |
| 4,029,863 | 6/1977 | Lemper | 526/88 |
| 4,253,994 | 3/1981 | Zakaria et al. | 524/526 |

FOREIGN PATENT DOCUMENTS

| | | |
|---|---|---|
| 2-191539 | 7/1990 | Japan . |
| 3-119190 | 5/1991 | Japan . |

*Primary Examiner*—Stanley S. Silverman
*Assistant Examiner*—Jose A. Fortuna
*Attorney, Agent, or Firm*—Wenderoth, Lind & Ponack, L.L.P.

[57] ABSTRACT

The invention provides a method for preventing pitch trouble which comprises adding to a pulp slurry a pitch-controlling agent comprising 100 parts by weight of a zinc salt of a higher fatty acid and from 1 to 20 parts by weight of a cationic surfactant.

4 Claims, No Drawings

METHOD FOR PREVENTING PITCH TROUBLE

This application is a 371 of international application PCT/JP96/00874 filed Mar. 28, 1996.

TECHNICAL FIELD

This invention relates to a novel pitch-controlling agent which is used in the production of wood pulp and paper, and also to a method for preventing pitch trouble by using such a pitch-controlling agent.

BACKGROUND ART

In the paper pulp industry, pitch has troubled the operations starting from pulping, for many years. The pitch trouble has presented a much more complicated aspect in the recent background that involves the promotion of the closed system for the improvement in the recycle of white water as well as the shortage of wood resources. In particular, the raw materials in papermaking have become diversified, and used paper with much size and wood from the South Sea Islands that has a large resin content have become used in large proportions. In addition, paper products have also become diversified, resulting in the necessity of using large amount of various chemicals in papermaking.

The pitch as referred to herein indicates a generic term for resinous substances contained in pulp (GP, TMP, KP or DIP among others), as known in the papermaking industry. This is originally dispersed in pulp slurry (paperstock) but is coagulated due to the change in pH, temperature or ion strength to form a sticky substance, which causes various troubles in papermaking. For example, the pitch adheres to papermaking devices, then accumulates thereon and soils products or gives defective products with holes.

The pitch is mostly derived from three groups; the first comprises resin acids, fatty acids, alcohols and non-saponified substances derived from wood, as well as those as denatured during pulping; the second comprises mainly adhesives or ink vehicles derived from used paper pulp; and the third comprises chemicals as originally added in papermaking but not fixed on paper products, such as starch, synthetic paper enhancers or sizing agents.

In order to prevent or reduce the pitch trouble, various pitch-controlling agents have heretofore been proposed. For example, various organic and inorganic pitch-controlling agents have been proposed such as those described in Japanese Patent Publication No. 45-25322, Japanese Patent Laid-Open Nos. 55-84491, 55-80598, 63-264993, 3-244698, 4-352898, 4-202299, 4-300383, among others. However, none of these has produced a satisfactory effect in preventing pitch trouble.

Recently, in addition, slime trouble caused by microorganisms has increased along with the increase in the above-mentioned pitch trouble. The slime trouble is such that the slime adheres to papermaking devices thereby interfering with the smooth papermaking operation and soiling products. The combination of pitch trouble and slime trouble results in the synergistic effect of the two, thereby producing so-called deposit trouble.

The present inventor has intensively investigated in order to solve the above-mentioned pitch trouble in the paper pulp industry and, as a result, he has found that a pitch-controlling agent comprising zinc salts of higher fatty acids and cationic surfactants well prevents pitch trouble, while increasing the sizing degree in the resulting paper and also increasing the papermaking speed as well as the retentiveness of paper stock in papermaking. On the basis of these findings, the inventor has completed this invention.

Most paper products are sized in order to make them resistant to the penetration of liquid, such as ink or water, therethrough. The sizing degree indicates the degree of the sizing effect. Sizing enlarges the contact angle on paper and increases the hydrophobic degree of paper.

Specifically, the object of the present invention is to provide a novel pitch-controlling agent capable of well preventing pitch trouble and, in addition, producing other favorable characteristics such as the sizing effect, and also to provide a method for preventing pitch trouble by using such a pitch-controlling agent.

DISCLOSURE OF THE INVENTION

According to the present invention, there is provided a pitch-controlling agent comprising 100 parts by weight of a zinc salt of a higher fatty acid and from 1 to 20 parts by weight of a cationic surfactant. The pitch-controlling agent is generally used in the form of an aqueous dispersion thereof.

In addition, there is further provided according to the invention a method for preventing pitch trouble by adding a pitch-controlling agent of an aqueous dispersion comprising 100 parts by weight of a zinc salt of a higher fatty acid and from 1 to 20 parts by weight of a cationic surfactant, to pulp slurry.

In the present invention, the higher fatty acid for the zinc salt of a higher fatty acid is a saturated or unsaturated monocarboxylic acid having from 8 to 30 carbon atoms. Therefore, the higher fatty acid includes, for example, saturated fatty acids such as caprylic acid, caproic acid, capric acid, lauric acid, myristic acid, palmitic acid, stearic acid, arachic acid, behenic acid, lignoceric acid, cerotic acid, montanic acid or melissic acid; and unsaturated fatty acids such as oleic acid, linolic acid or linolenic acid. Tall oil fatty acids are also within the scope of the higher fatty acid for use in the invention.

The higher fatty acid for use in the invention may have hydroxyl, carbonyl or epoxy groups in the molecule. Such higher fatty acid include, for example, ricinoleic acid or 12-hydroxystearic acid.

Of such various higher fatty acids, myristic acid, palmitic acid, stearic acid or mixtures of these are especially preferred for use in the invention.

The pitch-controlling agent of the invention may be obtained by dispersing a commercially available zinc salt of a higher fatty acid in water in the presence of a cationic surfactant.

However, according to the invention, it is possible to immediately prepare an aqueous dispersion comprising a zinc salt of a higher fatty acid and a cationic surfactant by adding a molten higher fatty acid to water containing zinc oxide dispersed therein, thereby reacting the higher fatty acid with the zinc oxide with stirring in the presence of a cationic surfactant. If desired, the resulting aqueous dispersion may be concentrated or diluted with water. Also, if desired, an additional cationic surfactant may be added thereto. In this manner, there is readily obtained the pitch-controlling agent of the invention. The pitch-controlling agent obtained in this manner is low-priced and, in addition, the particles of the zinc salt of a higher fatty acid obtained in this manner are smaller than those of a commercially available zinc salt of a higher fatty acid. Accordingly, the use of a smaller amount of the zinc salt of a higher fatty acid prepared according to the invention than the commercially available zinc salt makes it possible to prepare an effective pitch-controlling agent.

When the above mentioned process is employed, the pitch-controlling agent of the invention is prepared by use of zinc oxide usually in an amount of 0.45–0.65 moles per mole of the higher fatty acid used and a cationic surfactant in an amount of 2–15% by weight, preferably in an amount of 5–10% by weight, based on the higher fatty acid used. The amount of water as a reaction medium is not specifically limited, but it is usually in the range of about 1 to 3 times by weight of the resulting zinc salt of a higher fatty acid.

In more detail, zinc oxide is dispersed in water, and preferably the resulting dispersion is heated to a temperature more than the melting point of the higher fatty acid used. A molten higher fatty acid is then gradually added to the dispersion and is reacted with zinc oxide in he presence of a cationic surfactant. It is desirable that even after the addition of the higher fatty acid, the reaction mixture is maintained at a temperature more than the melting point of the higher fatty acid used, and the reaction mixture is further stirred usually for several hours. The upper limit of the reaction temperature is not specifically limited, but it is usually about 110° C. If desired, the reaction may be conducted either under reduces pressures or under increased pressures.

It is desirable that the pitch-controlling agent of the invention comprises the zinc salt of a higher fatty acid having an average particle size of 0.1 to 5 μm. When the pitch-controlling agent of the invention is prepared in accordance with the process mentioned hereinabove, the zinc salt of a higher fatty acid is obtained in a yield as high as from 95 to 99%. In addition, the process easily gives a zinc salt of a higher fatty acid having the average particle size mentioned above. In particular, the process readily provides a stable aqueous dispersion comprising fine particles of a zinc salt of a higher fatty acid having an average particle size of 0.2–2.0 μm, most preferably 0.3–1.0 μm, at a concentration of the zinc salt of 20–50%, while containing a cationic surfactant in amount of 1–20 parts by weight per 100 parts by weight of the zinc salt.

The cationic surfactant used in the invention includes, for example, higher alkylamine salts such as acetates or hydrochlorides, ethylene oxide adducts to higher condensates of higher fatty acids and polyalkylenepolyamines such as 1:1 (by mol) condensates of oleic acid and pentaethylenehexamine, salts of esters of higher fatty acids and alkanolamines such as triethanolamine stearate formate (Soromin A-type available from B.A.S.F.(I.G.)), salts of higher fatty acid amides such as stearamidoethyldiethylamine acetate (Sapamin A-type available from Ciba-Geigy), salts prepared by condensing higher fatty acids and aminoethylethanolamine under heat followed by bonding urea thereto and neutralizing the resulting condensate with acetic acid (e.g., Ahcovel A- or G-type cationic surfactant available from Ciba-Geigy), imidazoline-type cationic surfactants such as 2-heptadecenylhydroxyethylimidazoline (Amine 0 available from Ciba-Geigy), higher alkyltrimethylammonium salts such as lauryltrimethylammonium chloride, higher alkyldimethylbenzylammonium salts such as lauryldimethylbenzylammonium chloride, quaternary ammonium salts of higher fatty acid amides such as products as produced by quaternating tertiary amines derived from N,N-diethylethylenediamine and higher fatty acids with alkylating agents (Sapamin MS or Sapamin BCH available from Ciba-Geigy or Catanac SN available from American Cyanamid Co.), and alkylpyridinium salts. In the production of these cationic surfactants, tall oil fatty acids (consisting essentially of oleic acid and linoleic acid), for example, are preferably employed as higher fatty acids.

Among these cationic surfactants are particularly preferred condensates of higher fatty acids and polyalkylenepolyamines such as 1:1 (by mol) condensates of tall oil fatty acids and pentaethylenehexamine, or salts prepared by condensing higher fatty acids and aminoethylethanolamine under heat followed by bonding urea thereto and neutralizing the resulting condensates with acetic acid such as Ahcovel A- or G-type cationic surfactants.

The pitch-controlling agent of the invention comprises a cationic surfactant in an amount of 1–20 parts by weight, preferably in an amount of 5–15 parts by weight, per 100 parts by weight of zinc salt of a higher fatty acid. The pitch-controlling agent of the invention is used usually in the form of an aqueous dispersion containing about 40% by weight of a zinc salt of a higher fatty acid, although not limitative.

The pitch-controlling agent of the invention is added to pulp slurry prior to making the slurry into paper, by which any pitch trouble during papermaking can be effectively prevented. The amount of the pitch-controlling agent to be added is varied suitably, depending on the amount of pitch in the pulp slurry, but is, in general, from 0.01 to 0.25 parts by weight, in terms of the zinc salt of a fatty acid therein, per 100 parts by weight of the solid content or pulp in the slurry. Though not specifically limited, the pitch-controlling agent may be usually added to mixing chests, machine chests, or fan pumps.

INDUSTRIAL APPLICABILITY

The pitch-controlling agent of the present invention comprises a zinc salt of a higher fatty acid, preferably fine particles thereof, along with a cationic surfactant. In this, the surfaces of fine particles of a zinc salt of a higher fatty acid are positively charged, while the pitch and the pulp (fibers) in the pulp slurry are, in general, negatively charged. Therefore, the fine particles of a zinc salt of a higher fatty acid trap the colloidal pitch in the pulp slurry and are fixed on pulp along with the thus trapped pitch. In that manner, the pitch-controlling agent of the invention can efficiently prevent pitch trouble. In addition, when the pitch-controlling agent of the invention is used in papermaking, the pitch contained in wet paper being formed on wire gauze shall lose its adhesiveness since the wet paper adsorbs the fine particles of a zinc salt of a higher fatty acid thereon, and, as a result, the adhesion of pitch to wire gauze can also be prevented. These effects result from the almost quantitative adsorption of the fine particles of a zinc salt of a higher fatty acid that has been added to the pulp slurry, onto the fibers constituting the paper made from the slurry.

The use of the pitch-controlling agent of the invention in papermaking reduces the amount of adhesive substances that may adhere to various devices, so that any slime trouble in papermaking can be prevented. Accordingly, the use of the pitch-controlling agent of the invention together with a bactericidal or fungicidal agent or an enzyme preparation as a slime-controlling agent prevent effectively any deposit trouble.

Furthermore, when being used in papermaking, the pitch-controlling agent of the invention is adsorbed onto paper being made while the zinc salt of a higher fatty acid thus adsorbed produces a large contact angle for water.

Accordingly, the paper produced may have an increased sizing degree and hence the amount of the sizing agent to be added can be reduced. In addition, wet paper itself being made may have increased hydrophobicity and therefore can be dried rapidly. Using the pitch-controlling agent of the invention, therefore, it is possible to realize the acceleration of the papermaking speed and the reduction in the fuel cost.

As additional advantages, for example, since zinc stearate is a white powder, it can be adsorbed onto paper being made to thereby mask black peppers of pitch and carbon particles on the surface of the paper. In addition, when the pitch-controlling agent of the invention is used in papermaking, the fine particles of a zinc salt of a fatty acid in the agent can well trap even the fine fibers in the pulp slurry, as mentioned hereinabove, and therefore the retention of paper stock in papermaking can be increased.

Alkaline earth metal salts and aluminium salts of higher fatty acids are also white and highly repellent to water. Of these, calcium salts of higher fatty acids are widely used as components in lubricants or defoaming agents. However, even dispersions of fine particles of such salts prepared in the presence of cationic surfactants are poorly effective in preventing pitch trouble, if used as pitch-controlling agents. Moreover, being different from zinc salts, these salts are poorly fixed onto paper.

Reference examples for producing aqueous dispersions of zinc salts of higher fatty acids in the presence of cationic surfactants as well as examples of the present invention are described hereinunder, which, however, do not whatsoever limit the present invention. In the following examples, the amount of the pitch-controlling agent used is represented by parts by weight of zinc stearate per 100 parts by weight of the solid content or pulp in the pulp slurry.

Reference Example 1

5.95 g of zinc oxide was dispersed in 90 g of distilled water and 2.4 g of a cationic surfactant or a condensate of tall oil fatty acids and pentaethylenehexamine at about 1:1 (by mol) was dissolved in the water. 35 g of stearic acid (m.p.: 56° C.) as previously melted under heat at about 70° C. was gradually added to the mixture with full stirring. After the addition, the resulting reaction mixture was further stirred for 3 hours under heat at 60° C.

After the reaction, the reaction mixture was allowed to cool to room temperatures, thereby providing an aqueous dispersion of zinc stearate. The yield of zinc stearate was found to be 95.7%.

The aqueous dispersion had a zinc stearate concentration of 28.3% by weight and a cationic surfactant concentration of 1.9% by weight and had a viscosity of 60 centipoises at 25° C. The average particle size of zinc stearate in the dispersion was found to be 0.5 μm.

Reference Example 2

In the same manner as in Reference Example 1 except that 2.8 g of a condensate of tall oil fatty acids and aminoethylethanolamine at about 1:1 (by mol) (Ahcovel A-type) was used as a cationic surfactant, an aqueous dispersion of zinc stearate was obtained. The yield of zinc stearate was found to be 96.1%.

The aqueous dispersion had a zinc stearate concentration of 28.8% by weight and a cationic surfactant concentration of 2.2% by weight and had a viscosity of 45 centipoises at 25° C. The average particle size of zinc stearate in the dispersion was found to be 0.6 μm.

Reference Example 3

In the same manner as in Reference Example 1 except that a mixture of 1.0 g of a condensate of oleic acid and pentaethylenehexamine and 1.6 g of a condensate of palmitic acid and aminoethanolamine (Ahcovel A-type) was used as a cationic surfactant, an aqueous dispersion of zinc stearate was obtained. The yield of zinc stearate was found to be 95.8%.

The aqueous dispersion had a zinc stearate concentration of 28.5% by weight and a cationic surfactant concentration of 2.0% by weight and had a viscosity of 50 centipoises at 25° C. The average particle size of zinc stearate in the dispersion was found to be 0.4 μm.

Reference Example 4

In the same manner as in Reference Example 1 except that 4.0 g of a nonionic surfactant or an adduct of ethylene oxide (6 mol) to lauryl alcohol was used, an aqueous dispersion of zinc stearate was obtained. The yield of zinc stearate was found to be 99.0%.

The aqueous dispersion had a zinc stearate concentration of 29.8% by weight and had a viscosity of 130 centipoises at 25° C. The average particle size of zinc stearate in the dispersion was found to be 2.0 μm.

Reference Example 5

In the same manner as in Reference Example 1 except that 2.0 g of an anionic surfactant or sodium dodecylsulfate was used, an aqueous dispersion of zinc stearate was obtained. The yield of zinc stearate was found to be 97.3%.

The aqueous dispersion had a zinc stearate concentration of 29.9% by weight and had a viscosity of 150 centipoises at 25° C. The average particle size of zinc stearate in the dispersion was found to be 2.3 μm.

Reference Example 6

In the same manner as in Reference Example 1 except that 5.43 g of calcium hydroxide was used in place of 5.95 g of zinc oxide, an aqueous dispersion of calcium stearate was obtained. The yield of calcium stearate was found to be 99.5% based on stearic acid.

The aqueous dispersion had a calcium stearate concentration of 30.8% by weight and had a viscosity of 40 centipoises at 25° C. The average particle size of calcium stearate in the dispersion was found to be 0.7 μm.

(Effect in Preventing Pitch Trouble)

EXAMPLE 1

The aqueous dispersion of zinc stearate prepared in Reference Example 1 was directly used herein as a pitch-controlling agent.

The pitch-controlling agent was used in the preparation of pulp for corrugating media and the effect of the agent to prevent pitch trouble was examined in accordance with J. TAPPI paper pulp testing method No. 11, that is, a method for measuring the amount of pulp pitch as adhered onto wire gauze. The amount of the pitch adhered is measured using a pitch tester. The temperature for the test was 50° C. Aluminum sulfate was added to pulp slurry to adjust the slurry at a pH of 5.5 or 4.5, and the amount of the pitch adhered onto wire gauze was measured, from which the degree of removal of pitch was obtained. The degree of removal of pitch is as follows: [(amount of pitch adhered in the absence of pitch-controlling agent (blank)—amount of pitch adhered in the presence of pitch-controlling agent)/(amount of pitch adhered in the absence of pitch-controlling agent)]×100 (%). The results are shown in Table 1.

EXAMPLE 2

The aqueous dispersion of zinc stearate prepared in Example 2 was directly used herein as a pitch-controlling agent. The effect of the agent to prevent the pitch trouble in preparing pulp for newsprint paper was examined in the same manner as in Example 1. The results are shown in Table 1.

EXAMPLE 3

The aqueous dispersion of zinc stearate prepared in Reference Example 3 was directly used herein as a pitch-controlling agent. The effect of the agent to prevent the pitch trouble in preparing pulp for raw paper for coated paper was examined in the same manner as in Example 1. The results are shown in Table 1.

Comparative Example 1

The aqueous dispersion of zinc stearate as prepared in Reference Example 4 was used as a pitch-controlling agent in place of the dispersion of zinc stearate prepared in Reference Example 1. The effect of the agent to prevent the pitch trouble was examined in the same manner as in Example 1. The results are shown in Table 1.

Comparative Example 2

The aqueous dispersion of calcium stearate as prepared in Reference Example 6 was used as a pitch-controlling agent in place of the dispersion of zinc stearate prepared in Reference Example 1, and the same test as in Example 1 was repeated to test the effect of the dispersion in preventing the pitch trouble. The results obtained are shown in Table 1.

TABLE 1

| | | pH: 5.5 | | pH: 4.5 | |
|---|---|---|---|---|---|
| | Added Amount (parts) | Amount of Pitch on Wire Gauze (g) | Degree of Removal of Pitch (%) | Amount of Pitch on Wire Gauze (g) | Degree of Removal of Pitch (%) |
| Example 1 | Blank | 1.417 | — | 1.365 | — |
| | 0.03 | 0.921 | 35.0 | 0.905 | 33.7 |
| | 0.06 | 0.424 | 70.1 | 0.431 | 68.4 |
| | 0.10 | 0.421 | 70.3 | 0.437 | 68.0 |
| Example 2 | Blank | 0.541 | — | 0.513 | — |
| | 0.03 | 0.272 | 49.7 | 0.203 | 60.4 |
| | 0.06 | 0.184 | 66.0 | 0.140 | 72.7 |
| | 0.10 | 0.115 | 78.7 | 0.101 | 80.3 |
| Example 3 | Blank | 0.318 | — | 0.259 | — |
| | 0.03 | 0.174 | 45.3 | 0.137 | 47.1 |
| | 0.06 | 0.117 | 63.2 | 0.103 | 60.2 |
| | 0.10 | 0.101 | 68.2 | 0.098 | 62.2 |
| Comparative 1 | Blank | 1.417 | — | — | — |
| | 0.03 | 1.311 | 7.5 | — | — |
| | 0.06 | 1.294 | 8.7 | — | — |
| | 0.10 | 1.246 | 12.0 | — | — |
| Comparative 2 | Blank | 1.417 | — | — | — |
| | 0.03 | 1.183 | 16.5 | — | — |
| | 0.06 | 0.984 | 30.6 | — | — |
| | 0.10 | 0.956 | 32.5 | — | — |

(Measurement of Amount of Zinc Fixed onto Paper)

EXAMPLE 4

The aqueous dispersions of zinc stearate as prepared in Reference Examples 1, 4 and 5 were directly used as pitch-controlling agents herein, respectively.

0.03 parts by weight, 0.06 parts by weight or 0.10 parts by weight of each of these pitch-controlling agents was added to a slurry of pulp (bleached kraft pulp with N/L ratio=3/2) having a Canadian standard freeness of 550 ml and a pH of 5.2, and the slurry was made into paper using a TAPPI standard-type, manual papermaking machine. The wet paper obtained was dewatered under pressure at 3 kg/cm$^2$ for 5 minutes and then air-dried overnight to prepare experimental paper samples.

The paper sample thus obtained was cut into pieces, about 1 g of which were precisely weighed, put into a crucible and fired into ash. The hydrochloric acid soluble substance was diluted to a volume of 100 ml for use as a sample for atomic photoabsorption analysis. As the blank, a paper sample was prepared in the absence of the pitch-controlling agent.

After the quantitative analysis of zinc, the degree of fixation of zinc onto paper was obtained from the following equation. The results obtained are shown in Table 2. All zinc was substantially trapped by and fixed onto paper as made in the presence of the pitch-controlling agent of the invention.

Degree of Fixation of Zinc=[(amount of zinc in sample prepared in the presence of pitch-controlling agent/g of paper—amount of zinc in sample prepared in the absence of pitch-controlling agent/g of paper)/amount of zinc in pitch-controlling agent used/g of paper]×100 (%)

TABLE 2

| Pitch-Controlling Agent | Amount Used (parts) | Degree of Fixation of Zinc (%) |
|---|---|---|
| Prepared in Reference | 0.03 | 88 |

TABLE 2-continued

| Pitch-Controlling Agent | Amount Used (parts) | Degree of Fixation of Zinc (%) |
|---|---|---|
| Example 1 | 0.06 | 92 |
| (Example) | 0 10 | 95 |
| Prepared in Reference | 0.03 | 25 |
| Example 4 | 0.06 | 38 |
| (Example) | 0 10 | 45 |
| Prepared in Reference | 0.03 | 19 |
| Example 5 | 0.06 | 31 |
| (Comparative) | 0 10 | 42 |

(Determination of Sizing Effect)

EXAMPLE 5

The aqueous dispersion of zinc stearate as prepared in Reference Example 1 was directly used herein as a pitch-controlling agent.

The pitch-controlling agent was added to a slurry of pulp (bleached kraft pulp with N/L ratio=1/1) having a Canadian standard freeness of 500 ml and a pH of 4.9, and the slurry was made into paper using a TAPPI standard-type, manual papermaking machine.

The wet paper obtained was dewatered under pressure at 3 kg/cm$^2$ for 5 minutes and then dried in a rotary drier at 150° C. for 30 seconds. The thus obtained paper was conditioned at 20° C. and at a relative humidity of 65% for 24 hours so that it had a weight of 70±1 g/cm$^2$.

The paper sample thus obtained was tested to determine its Stoeckigt sizing degree in accordance with the method stipulated in JIS P-8122. The results obtained are shown in Table 3.

TABLE 3

| | Amount Used (parts) | Sizing Degree (sec.) |
|---|---|---|
| Example 5 | Blank | 0 |
| | 0.03 | 2.0 |
| | 0.06 | 4.5 |
| | 0.10 | 120.0 |

EXAMPLE 6

The aqueous dispersion of zinc stearate as prepared in Reference Example 2 was directly used herein as a pitch-controlling agent.

0.5 % of a paper enhancer, amphoteric acrylamide was added to pulp for corrugating media to prepare a slurry having a pH of 5.0, and the pitch-controlling agent was added to the slurry. The slurry was then made into paper using a TAPPI standard-type, manual papermaking machine. Then, the wet paper obtained was dewatered, dried under heat and conditioned in the same manner as in Example 5 so that it had a weight of 150±1 g/cm$^2$.

The paper sample thus obtained was tested to determine its Stoeckigt sizing degree in the same manner as in Example 5. The results obtained are shown in Table 4.

TABLE 4

| | Amount Used (parts) | Sizing Degree (sec.) |
|---|---|---|
| Example 6 | Blank | 0.6 |
| | 0.03 | 150.0 |
| | 0.06 | 310.0 |
| | 0.10 | 430.0 |

(Evaluation of Dryability of Wet Paper)

EXAMPLE 7

The aqueous dispersion of zinc stearate as prepared in Reference Example 3 was directly used herein as a pitch-controlling agent.

1.0% of a paper enhancer, amphoteric acrylamide was added to pulp for corrugating media to prepare a slurry having a pH of 5.0, and the pitch-controlling agent was added to the slurry. The slurry was then made into paper using a TAPPI standard-type, manual papermaking machine. Then, the wet paper obtained was dewatered, dried under heat and conditioned in the same manner as in Example 5 so that it had a weight of 150±1 g/cm$^2$.

The wet paper obtained was dewatered under pressure at 3 kg/cm$^2$ for 5 minutes and immediately the amount of water being vaporized was measured at predetermined intervals of time in a constant-temperature and constant-humidity condition at 20° C. and at a relative humidity of 65%. The results obtained are shown in Table 5.

TABLE 5

| Time | Amount of Water Vaporized (mg) Amount Used of Agent (parts) | | | |
|---|---|---|---|---|
| (min.) | Blank | 0.03 | 0.06 | 0.10 |
| 1 | 0 | 0 | 0 | 0 |
| 5 | 23 | 29 | 27 | 26 |
| 10 | 44 | 50 | 54 | 56 |
| 15 | 63 | 69 | 80 | 90 |
| 20 | 79 | 88 | 103 | 120 |

I claim:

1. A method for preventing pitch trouble which comprises adding to pulp slurry, prior to making the slurry into paper, a pitch-controlling agent of an aqueous dispersion comprising 100 parts by weight of a zinc salt of a higher fatty acid of 8 to 30 carbons and from 1 to 20 parts by weight of a cationic surfactant.

2. The method for preventing pitch trouble as claimed in claim 1, wherein the zinc salt of a higher fatty acid is zinc stearate.

3. The method as claimed in claim 1, wherein the zinc stearate has an average particle size of from 0.1 to 5 μm.

4. The method as claimed in claim 1, wherein the pitch-controlling agent is added to pulp slurry in an amount of from 0.01 to 0.25 parts by weight in terms of the zinc salt of a fatty acid per 100 parts by weight of the pulp content in the slurry.

* * * * *